US010035967B2

(12) United States Patent
Yoshida et al.

(10) Patent No.: US 10,035,967 B2
(45) Date of Patent: Jul. 31, 2018

(54) METHOD FOR PRODUCING ASH-FREE COAL

(71) Applicant: KOBE STEEL, LTD., Kobe-shi (JP)

(72) Inventors: Takuya Yoshida, Hyogo (JP); Noriyuki Okuyama, Hyogo (JP); Shigeru Kinoshita, Hyogo (JP); Koji Sakai, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/782,693

(22) PCT Filed: Apr. 15, 2014

(86) PCT No.: PCT/JP2014/060739
§ 371 (c)(1),
(2) Date: Oct. 6, 2015

(87) PCT Pub. No.: WO2014/171460
PCT Pub. Date: Oct. 23, 2014

(65) Prior Publication Data

US 2016/0060558 A1 Mar. 3, 2016

(30) Foreign Application Priority Data

Apr. 16, 2013 (JP) ..... 2013-085780

(51) Int. Cl.
*C10L 9/10* (2006.01)
*C10L 5/04* (2006.01)
*C10L 9/00* (2006.01)

(52) U.S. Cl.
CPC ..... *C10L 9/10* (2013.01); *C10L 5/04* (2013.01); *C10L 9/00* (2013.01); *C10L 2290/06* (2013.01);
(Continued)

(58) Field of Classification Search
USPC ..... 44/627
See application file for complete search history.

(56) References Cited

U.S. PATENT DOCUMENTS 6,162,265 A * 12/2000 Dunlop ..... C10B 57/10 44/620
2009/0217574 A1* 9/2009 Coleman ..... C10L 5/00 44/501
(Continued)

FOREIGN PATENT DOCUMENTS

JP 4-358502 A 12/1992
JP 2007-3039 A 1/2007
(Continued)

OTHER PUBLICATIONS

International Search Report and Written Opinion dated Jul. 8, 2014 in PCT/JP2014/060739 (with English language translation).
(Continued)

*Primary Examiner* — Prem C Singh
*Assistant Examiner* — Chantel Graham
(74) *Attorney, Agent, or Firm* — Oblon, McClelland, Maier & Neustadt, L.L.P.

(57) ABSTRACT

A method for producing an ashless coal which includes a slurry preparation step, an extraction step, a separation step, an ashless coal acquirement step, and a by-product acquirement step. The separation step is conducted under the state of being pressurized to a pressure equal to or higher than a vapor pressure of the solvent. In the by-product acquirement step, the solvent is evaporated and separated from the solid content-concentrated slurry by spraying the solid content-concentrated slurry into a flash tank in which a pressure is set to lower than a saturation pressure of the solid content-concentrated slurry from a spray nozzle while maintaining a pressure of the solid content-concentrated slurry in a nozzle
(Continued)

orifice of the spray nozzle at a level equal to or higher than the vapor pressure of the solvent.

6 Claims, 4 Drawing Sheets

(52) U.S. Cl.
CPC ..... *C10L 2290/18* (2013.01); *C10L 2290/24* (2013.01); *C10L 2290/48* (2013.01); *C10L 2290/52* (2013.01); *C10L 2290/54* (2013.01); *C10L 2290/544* (2013.01); *C10L 2290/547* (2013.01)

(56) References Cited

U.S. PATENT DOCUMENTS

| | | | |
|---|---|---|---|
| 2010/0006477 | A1 | 1/2010 | Okuyama et al. |
| 2014/0305034 | A1 | 10/2014 | Sakai et al. |

FOREIGN PATENT DOCUMENTS

| | | | |
|---|---|---|---|
| JP | 2009-126951 | A | 6/2009 |
| JP | 2009-226259 | A | 10/2009 |
| JP | 2009-227718 | A | 10/2009 |
| WO | WO 2008/044728 | A1 | 4/2008 |
| WO | WO 2013/099650 | A1 | 7/2013 |

OTHER PUBLICATIONS

Li-hua Fan, "Research Progress on Ash-Free Coal Preparation and Application", Coal Science and Technology, vol. 39, No. 3, 2011, pp. 120-124 (with English Abstract).

* cited by examiner

METHOD FOR PRODUCING ASH-FREE COAL

TECHNICAL FIELD

The present invention relates to a method for producing an ashless coal, for acquiring an ashless coal in which ash components have been removed from a coal.

BACKGROUND ART

A method for producing an ashless coal is disclosed in Patent Document 1. In such a production method, a raw material coal as a mixture of steam coal and caking coal is mixed with a solvent to prepare a slurry, and the slurry thus prepared is heated, thereby extracting coal components soluble in the solvent, then the gravitational settling method is applied to the slurry in which the coal components has been extracted, thereby separating the slurry into a solution which contains the coal components soluble in the solvent and a solid-content concentrated slurry containing coal components insoluble in the solvent, and further the removal of the solvent from the separated solution is carried out, thereby obtaining an ashless coal. In addition, the solvent is separated from the separated solid-content concentrated slurry, thereby obtaining a by-product coal.

An ashless coal and a by-product coal are present as a solute in an organic solvent in its production process, but convert to a solid state when a solvent has removed, followed by cooling. Patent Document 2 discloses a spray drying method of spraying a preheated solution to a collection plate provided in a main body container from a spray nozzle to evaporate a solvent in the solution by heat transfer from the collection plate as a method for removing (recovering) a solvent. Patent Document 3 discloses a solvent recovering method of dispersing a solution toward an inner wall heated in a solvent separation tower using a rotary dispersion mechanism rotating the solvent, thereby volatilizing a solvent in the solution.

PRIOR ART DOCUMENT

Patent Documents

Patent Document 1: JP-A-2009-227718
Patent Document 2: JP-A-2007-3039
Patent Document 3: JP-A-2009-226259

SUMMARY OF THE INVENTION

Problem that the Invention is to Solve

However, Patent Document 2 has the problem that a spray nozzle clogs. Clogging of the spray nozzle occurs in the case where a solvent is volatilized before a nozzle orifice and gas components adiabatically expand to decrease a temperature of a solution, and a solid matter precipitates.

Patent Document 2 and Patent Document 3 mainly utilize external heat to volatilize a solvent, and do not utilize heat or pressure of the solution in the course of a process. However, in the case of a continuous process assuming a mass production, there is a possibility that an apparatus of volatilizing a solvent as mentioned above can be simplified and input energy for volatilizing a solvent can be reduced, by utilizing properties of a solution-solid content concentrated slurry in the course of a process and heat or pressure of the solution-solid content concentrated slurry.

An object of the present invention is to provide a method for producing an ashless coal, that can simplify an apparatus of volatilizing a solvent by preventing clogging of a spray nozzle and additionally reducing input energy required for volatilizing the solvent.

Means for Solving the Problem

The method for producing an ashless coal in the present invention includes: a slurry preparation step of mixing a coal with a solvent, thereby acquiring a slurry; an extraction step of heating the slurry, thereby extracting a coal component soluble in the solvent; a separation step of separating the slurry which has been obtained in the extraction step into a solution in which the coal component soluble in the solvent is dissolved and a solid content-concentrated slurry in which a coal component insoluble in the solvent is concentrated; an ashless coal acquirement step of evaporating and separating the solvent from the solution which has been separated in the separation step, thereby acquiring an ashless coal; and a by-product acquirement step of evaporating and separating the solvent from the solid content-concentrated slurry which has been separated in the separation step, thereby acquiring a by-product coal, in which the separation step is conducted under the state of being pressurized to a pressure equal to or higher than a vapor pressure of the solvent, and in the by-product acquirement step, the solvent is evaporated and separated from the solid content-concentrated slurry by spraying the solid content-concentrated slurry into a flash tank in which a pressure is set to lower than a saturation pressure of the solid content-concentrated slurry from a spray nozzle while maintaining a pressure of the solid content-concentrated slurry in a nozzle orifice of the spray nozzle at a level equal to or higher than the vapor pressure of the solvent.

Advantageous Effects of the Invention

According to the method for producing an ashless coal in the present invention, an apparatus of volatilizing a solvent can be simplified by preventing clogging of a spray nozzle and additionally reducing input energy required for volatilizing the solvent.

EMBODIMENTS FOR CARRYING OUT THE INVENTION

The preferred embodiments of the present invention are described below by reference to the drawings.

(Production Method of Ashless Coal)

Figure 1:
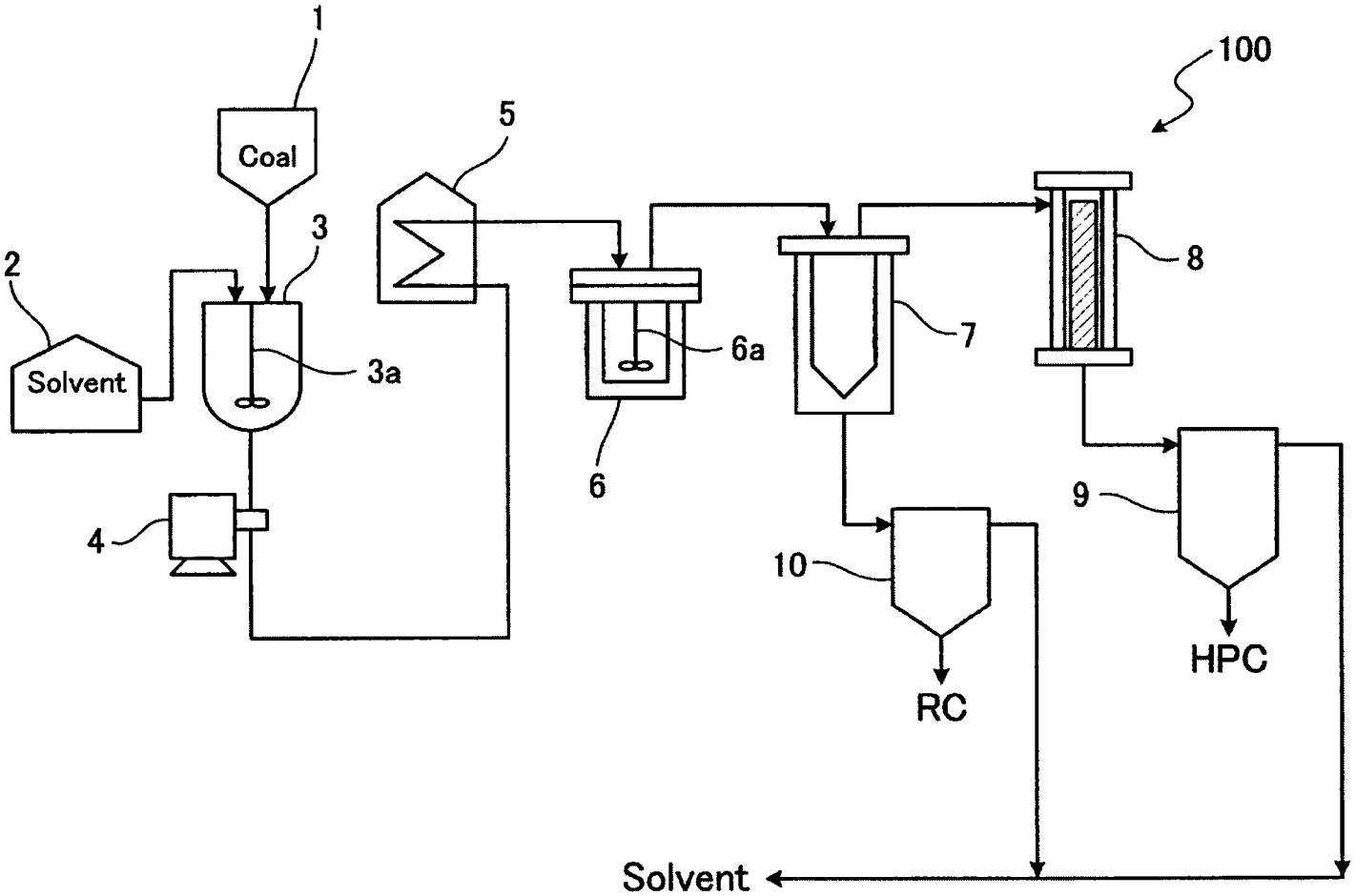
FIG. 1 is a schematic view of an ashless coal production equipment.

As shown in FIG. 1, an ashless coal production equipment 100 to be used in a production method of an ashless coal according to the present embodiment includes a coal hopper 1, a solvent tank 2, a slurry preparation tank 3, a transport pump 4, a preheater 5, an extraction tank 6, a gravitational settling tank 7, a filter unit 8 and solvent separators 9 and 10, in the order from an upstream side of a production process of an ashless coal (HPC).

The method of producing an ashless coal includes a slurry preparation step, an extraction step, a separation step, an ashless coal acquirement step and a by-product coal acquirement step. Each of these steps is explained below. Additionally, a coal to be used as a raw material in the present production method has no particular restriction, and bituminous coal high in extraction rate may be used or a low rank coal low in price (such as subbituminous coal or brown coal) may be used. Herein, the term "ashless coal" refers to a coal having an ash content of 5 wt % or less, preferably 3 wt % or less.

(Slurry Preparation Step)

The slurry preparation step is a step of preparing a slurry by mixing a coal and a solvent. This slurry preparation step is performed in the slurry preparation tank 3 in FIG. 1. The coal as a raw material is added to the slurry preparation tank 3 from the coal hopper 1, and a solvent is added to the slurry preparation tank 3 from the solvent tank 2. The coal and solvent which has been added to the slurry preparation tank 3 are mixed by the stirrer 3*a*, thereby forming into a slurry composed of the coal and the solvent.

The mixing proportion of the coals to the solvent is, for example, from 10 to 50 wt %, preferably from 20 to 35 wt %, on a dried coal basis.

(Extraction Step)

The extraction step is a step of extracting coal components soluble in the solvent (a step of dissolving such components in the solvent) by heating the slurry obtained in the slurry preparation step. This extraction step is performed in the preheater 5 and the extraction tank 6 in FIG. 1. The slurry which has been prepared in the slurry preparation tank 3 is fed to the preheater 5 by means of the transport pump 4, heated up to a predetermined temperature, then fed to the extraction tank 6, and further kept at a predetermined temperature while stirring by the stirrer 6*a*. In this way, the extraction is performed.

In a case of extracting coal components soluble in the solvent by heating the slurry prepared by mixing the coal with the solvent, a solvent in which the coal is highly soluble, more specifically an aromatic solvent (a hydrogen donative solvent or a hydrogen nondonative solvent) in many cases, is mixed with a coal, and by heating the resulting mixture, organic components in the coal are extracted.

The hydrogen nondonative solvent is a coal-derived solvent obtained mainly by refining carbonization products of coal and predominantly composed of bicyclic aromatic compounds. Because such a hydrogen nondonative solvent is stable even under conditions of heating and has a high affinity for coal, the proportion of soluble components (coal components) extracted with the solvent (hereafter referred to as the extraction rate) is high, and the solvent can be easily recovered by the methods such as distillation. Main ingredients in the hydrogen nondonative solvent are bicyclic aromatic compounds such as naphthalene, methylnaphthalene, dimethylnaphthalene or trimethylnaphthalene. As the other ingredients in the hydrogen nondonative solvent, examples thereof include a naphthalene, a anthracene and a fluorine, which each have aliphatic side chains, and further include biphenyl and an alkylbenzene having long-chain aliphatic side chains.

Although the case of using a hydrogen nondonative compound as the solvent is described in the above explanation, it goes without saying that any of hydrogen donative compounds (including the case of coal liquefied oil), typified by tetralin, can be used as the solvent. The use of a hydrogen donative solvent brings about enhancement of ashless coal yield.

Additionally, the solvent has no particular restriction as to its boiling temperature. From the viewpoints of pressure reductions in the extraction step and separation step, an extraction rate in the extraction step, a solvent recovery rate in the ashless coal acquirement step and the like, solvents having boiling temperatures in a range of 180° C. to 300° C., especially 240° C. to 280° C., can be used favorably. In the present embodiment, the boiling temperature of the solvent is about 242° C.

The heating temperature of the slurry in the extraction step has no particular limitations so long as dissolution of solvent-soluble components can be achieved. From the viewpoint of ensuring thorough dissolution of solvent-soluble components and improvement in extraction rate, the heating temperature is, for example, from 300° C. to 420° C., preferably 360° C. to 400° C.

The heating time (extraction time) also has no particular limitations, but from the viewpoint of ensuring thorough dissolution and improvement in extraction rate, the heating time is, for example, from 10 to 60 minutes. Herein, the term "heating time" refers to the sum of the heating time in the preheater 5 in FIG. 1 and the heating time in the extraction tank 6 in FIG. 1.

The suitable pressure inside the extraction tank 6 is, for example, from 1.0 to 2.0 MPa, though it depends on the temperature during the extraction and the vapor pressure of a solvent to be used. When the pressure inside the extraction tank 6 is lower than the vapor pressure of the solvent, the solvent vaporizes and the solvent cannot be confined within the liquid phase, and the extraction ends in failure. In order to confine the solvent within the liquid phase, the pressure higher than the vapor pressure of the solvent is therefore necessary. On the other hand, when the pressure is too high, it brings about increases in costs of equipment and operation, and it is therefore uneconomical.

(Separation Step)

The separation step is a step of separating the slurry which has been obtained in the extraction step into a solution in which coal components soluble in the solvent are dissolved and a solid-content concentrated slurry (solvent-insoluble component concentrated liquid) which contains coal components insoluble in the solvent (solvent-insoluble components such as ash components) in a concentrated state, by the gravitational settling method. This separation step is carried out in the gravitational settling tank 7 in FIG. 1. In the gravitational settling tank 7, the slurry which has been obtained in the extraction step is separated into supernatant liquor as the solution and the solid-content concentrated slurry by dint of gravity. The supernatant liquor in the upper part of the gravitational settling tank 7 is discharged into the solvent separator 9, if necessary, by way of the filter unit 8, and the solid-content concentrated slurry settled in the lower part of the gravitational settling tank 7 is discharged into the solvent separator 10.

The gravitational settling method is a method of holding the slurry in the tank, and settling and separating the solvent-insoluble components by exploiting gravity. The solvent-insoluble components (e.g. ash components) having a specific gravity larger than that of the solution in which coal components soluble in the solvent are dissolved, settle in the lower part of the gravitational settling tank 7 by the force of gravity. By continuously discharging the supernatant liquor from the upper part of the tank and the solid-content concentrated slurry from the lower part of the tank while continuously feeding the slurry into the tank, continuous separation treatment becomes possible.

It is preferred that the inside of the gravitational settling tank 7 is heat-retained (or heated) and pressurized in order to prevent reprecipitation of solvent-soluble components eluted from a coal. The heat-retaining (heating) temperature is, for example, from 300 to 380° C., and a pressure in the tank is, for example, from 1.0 to 3.0 MPa. In the present embodiment, the slurry is heated to 380° C. and pressurized to 2 MPa such that the solvent is not evaporated and separated from the solution fed to the solvent separator 9 and the solid content-concentrated slurry fed to the solvent separator 10.

In addition to the gravitational settling method, examples of methods for separating the solution which contains coal components dissolved in the solvent from the slurry which has been obtained in the extraction step include a filtration method, a centrifugal separation method and the like.

(Ashless Coal Acquirement Step)

The ashless coal acquirement step is a step of evaporating and separating the solvent from the solution (supernatant) which has been separated in the separation step, thereby acquiring the ashless coal (HPC). The ashless coal acquirement step is carried out in the solvent separator 9 in FIG. 1. The solution which has been separated in the gravitational settling tank 7 is filtered with the filter unit 8, and then fed to the solvent separator 9, and the solvent is evaporated and separated from the supernatant in the solvent separator 9. The filtration step using the filter unit 8 can be omitted. It is preferred that the evaporative separation of the solvent from the solution is conducted in the presence of an inert gas such as nitrogen. In the present embodiment, the solvent separator 9 is a flash distillation tank to be used in a flash evaporation process. In the flash evaporation process, a solution is sprayed or jetted into a flash tank to evaporate and separate a solvent. The solvent separator 9 includes a spray nozzle or jet nozzle which sprays a solution, and a flash tank into which a solution is sprayed or jetted.

A method for separating the solvent from the solution (supernatant) is not limited to the flash distillation method, and a common distillation process, common evaporation process or the like may be used. The solvent which has been separated in the solvent separator 9 is returned to the solvent tank 2, and is repeatedly used by circulation. Circulation use of the solvent is preferred but is not essential (the same applies to a by-product coal acquirement step mentioned after). An ashless coal (HPC) substantially free of an ash component can be obtained by separating the solvent from the supernatant.

The ashless coal contains almost no ash components, is absolutely free of moisture, and offers a calorific value higher than a raw material coal. In addition, the ashless coal has an extensive improvement in plastic properties (flowability) which are especially important for a raw material of steelmaking coke, and even when the raw material coal has no plastic properties, the ashless coal (HPC) obtained from it has excellent plastic properties. Accordingly, the ashless coal can be used, for example, in a coal blend as a raw material for making coke. Further, the ashless coal almost free of ash components has high combustion efficiency and can reduce the amount of coal ashes produced. Attention is therefore being given to the use of ashless coal as a gas turbine direct-injection fuel in a high-efficiency, combined-cycle generation system utilizing gas turbine combustion.

The solution which has been separated in the gravitational settling tank 7 under the situation that the solution was pressurized to 2 MPa which is a pressure equal to or higher than a vapor pressure of the solvent is in the state of 380° C. and 2 MPa in which the solvent is not evaporated and separated. The solution is sprayed from a spray nozzle into a flash tank in which the pressure is set to a pressure lower than a saturation pressure of the solvent, for example, an ordinary pressure. The saturation pressure of the solvent is lower than the vapor pressure of the solvent by vapor pressure depression phenomenon. The solution becomes a non-equilibrium state by spraying the solution which has been in state that the solvent is not evaporated and separated into a flash tank to expose to the state of the pressure lower than the saturation pressure of the solution. The solvent is evaporated and separated from the solution, and the solvent vapor adiabatically expands, thereby transiting to an equilibrium state under the pressure. Relaxation time which is the time required for the transition (volatilization of a solvent) of from the non-equilibrium state to the equilibrium state is short as from about 0.01 to 0.1 second. Therefore, volatilization phenomenon occurs in a very short period of time as compared with the conventional heat transfer step. Therefore, the solvent can be instantaneously evaporated and separated from the solution by utilizing the transition of from the non-equilibrium state to the equilibrium state.

When the solution is sprayed from a spray nozzle, the pressure of the solution in a nozzle orifice (ejection port) of the spray nozzle is maintained at a level equal to higher than the vapor pressure of the solvent. Specifically, the pressure of the solution in the nozzle orifice can be from about 1.1 to 2.0 MPa.

Clogging of the spray nozzle sometimes occurs in the following case: the pressure of the solution becomes lower than the saturation pressure of the solution before the nozzle orifice, and the solvent is volatized, and then, the temperature of the solution is decreased by adiabatically expanding a gas component, and a solid matter precipitates. Therefore, the solvent is not allowed to be volatilized before the nozzle orifice by maintaining the pressure of the solution in the nozzle orifice at a level equal to higher than the vapor pressure of the solvent. Because of this, clogging of the spray nozzle can be prevented.

The saturation pressure of the solution is lower than the vapor pressure of the solvent by vapor pressure depression phenomenon. Therefore, in the case where the pressure of the solution in the nozzle orifice is maintained at a level equal to higher than the saturation pressure of the solution, the solvent is not volatilized. Therefore, it is possible to make that the solvent is not allowed to be volatilized before the nozzle orifice by maintaining the pressure of the solution in the nozzle orifice at a level equal to higher than the saturation pressure of the solution.

The values of the temperature and pressure of the solution fed to the solvent separator 9 and the values of the temperature and pressure in the flash tank are set, respectively, in consideration of isenthalpic change of the solution in the flash tank and boiling point elevation phenomenon of the solvent. The relationship between the temperature of the solution by isenthalpic change of the solution and the solvent content can be estimated based on thermodynamics. The boiling point by boiling point elevation phenomenon of the solvent generated by dissolving a coal component soluble in the solvent in the solvent can be estimated from molality of the coal component. In the present embodiment, the boiling point of the solvent is increased to 280 to 290° C. from about 242° C. The solvent content of the ashless coal obtained by spraying into the flash tank is a value in the vicinity of an intersection point between an estimation curve of the solvent content calculated based on thermodynamics and a boiling point curve assumed from the boiling temperature elevation, or is a value between both curves in the case where the intersection point is not present. Therefore, the solvent content of the ashless coal obtained can be adjusted by setting the values of the temperature and pressure of the solution fed to the solvent separator 9 and the values of the temperature and pressure in the flash tank, respectively, in consideration of isenthalpic change of the solution in the flash tank and boiling point elevation phenomenon of the solvent. Specifically, in the case where the solvent content of the solution fed to the solvent separator 9 is 40 wt % and 62.5 wt %, ashless coals of 0.6 wt %, 4.1 wt %, 7.8 wt % and 10.3 wt % estimated from a gas-liquid equilibrium curve in which isenthalpic change and boiling point elevation phenomenon have been considered can be obtained by setting the temperature and pressure of the solution fed to the solvent separator 9 to 360° C. and 2 MPa and setting those in the flash tank to from 280 to 290° C. and an ordinary pressure.

The solvent may be further evaporated and separated from the solution from the solvent separator 9 by providing a flash distillation tank or thin film distillation apparatus different from the solvent separator 9 on the downstream side of the solvent separator 9. Thus, the solvent content of the ashless coal obtained in the ashless coal acquirement step can be adjusted to a predetermined value or less, for example, 20 wt % or less, by repeatedly conducting evaporative separation of the solvent from the solution.

(By-Product Coal Acquirement Step)

The by-product coal acquirement step is a step of evaporating and separating the solvent from the solid content-concentrated slurry which has been separated in the separation step, thereby acquiring a by-product coal. The by-product coal acquirement step is carried out in the solvent separator 10 in FIG. 1. The solid content-concentrated slurry which has been separated in the gravitation settling tank 7 is fed to the solvent separator 10, and the solvent is evaporated and separated from the solid content-concentrated slurry in the solvent separator 10. The evaporative separation of the solvent from the solid content-concentrated slurry is preferably performed in the presence of an inert gas such as nitrogen. In the present embodiment, the solvent separator 10 is a flash distillation tank to be used in a flash distillation method. The solvent separator 10 includes a spray nozzle of spraying a solution and a flash tank to which the solution is sprayed.

The method for separating the solvent from the solid content-concentrated slurry is not limited to the flash distillation method, and a common distillation method and evaporation method can be applicable thereto as in the case of the ashless coal acquirement step. The solvent which has been separated in the solvent separator 10 is returned to the solvent tank 2, and is repeatedly used by circulation. By the separation of the solvent, a by-product coal (RC, called a residue coal) in which solvent-insoluble components containing ash components and the like have been concentrated can be obtained from the solid content-concentrated slurry.

The by-product coal contains absolutely no moisture though it contains ash components, and has a sufficient calorific value. The by-product coal shows no coal plastic properties, and when used in a coal blend, it does not impair the coal plastic properties of other kinds of coals included in the coal blend because it has been subjected to elimination of oxygen-containing functional groups. Thus, this by-product coal can be used as a portion of the coal blend for coke-making material as in the case of usual non- or slightly-caking coals, and may also be used for various kinds of fuels without being used as a coke-making material.

The solid content-concentrated slurry which has been separated in the gravitational settling tank 7 is pressurized to a pressure equal to or higher than the vapor pressure of the solvent (2 MPa, 380° C.), and is in the state that the solvent is not evaporated and separated. The solid content-concentrated slurry is sprayed into a flash tank in which the pressure is set to a pressure lower than the saturation pressure of the solid content-concentrated slurry, for example, an ordinary pressure, from the spray nozzle. The solid content-concentrated slurry becomes a non-equilibrium state by spraying the solid content-concentrated slurry which has been in the state that the solvent is not allowed to be evaporated and separated, into the flash tank to expose to the state of the pressure lower than the saturation pressure. The state changes to an equilibrium state at that pressure by evaporating and separating the solvent from the solid content-concentrated slurry. Relaxation time which is the time required for the transition (volatilization of the solvent) of from a non-equilibrium state to an equilibrium state is short as from about 0.01 to 0.1 second. Therefore, volatilization phenomenon occurs in a very short period of time as compared with the conventional heat transfer step. Therefore, the solvent can be instantaneously evaporated and separated from the solid content-concentrated slurry by utilizing the transition of from the non-equilibrium state to the equilibrium state.

When the solid content-concentrated slurry is sprayed from the spray nozzle, the pressure of the solid content-concentrated slurry in a nozzle orifice (ejection port) of the spray nozzle is maintained at a level equal to or higher than the vapor pressure of the solvent. Specifically, the pressure of the solid content-concentrated slurry in the nozzle orifice can be from about 1.1 to 2.0 MPa.

Clogging of the spray nozzle sometimes occurs in the following case: the pressure of the solid content-concentrated slurry becomes lower than the saturation pressure before the nozzle orifice, and the solvent is volatilized, and then, a liquid phase in the solid content-concentrated slurry is decreased, and fluidity is decreased or lost. Therefore, the solvent is not allowed to be volatilized before the nozzle orifice by maintaining the pressure of the solid content-concentrated slurry in the nozzle orifice at a level equal to or higher than the vapor pressure of the solvent. Because of this, clogging of the spray nozzle can be prevented.

In the solvent separator 10, after the solvent is evaporated and separated from the solid content-concentrated slurry, thereby acquiring the by-product coal, an inert gas such as a nitrogen gas is introduced into a flash tank to substitute the solvent vapor with the inert gas in the flash tank, and the inert gas is brought into contact with the by-product coal. A tank storing the by-product coal may be separately provided on the downstream side of the solvent separator 10, and the inert gas may be introduced into the tank. In this case, the pressure in the tank is lower than the vapor pressure of the solvent.

The by-product coal is porous particles and has properties of adsorbing the solvent. It is therefore found that the by-product coal adsorbs the vapor in an amount up to about 5 wt % in the atmosphere of the solvent vapor. Therefore, the solvent vapor is removed from the circumference of the by-product coal by contacting the inert gas with the by-product coal which has been obtained by evaporating and separating the solvent, and the solvent vapor adsorbed in pores is substituted with the inert gas. This can reduce the solvent content of the by-product coal to about 2 wt %.

(Evaluation of Nozzle Flow Rate)

Figure 2:
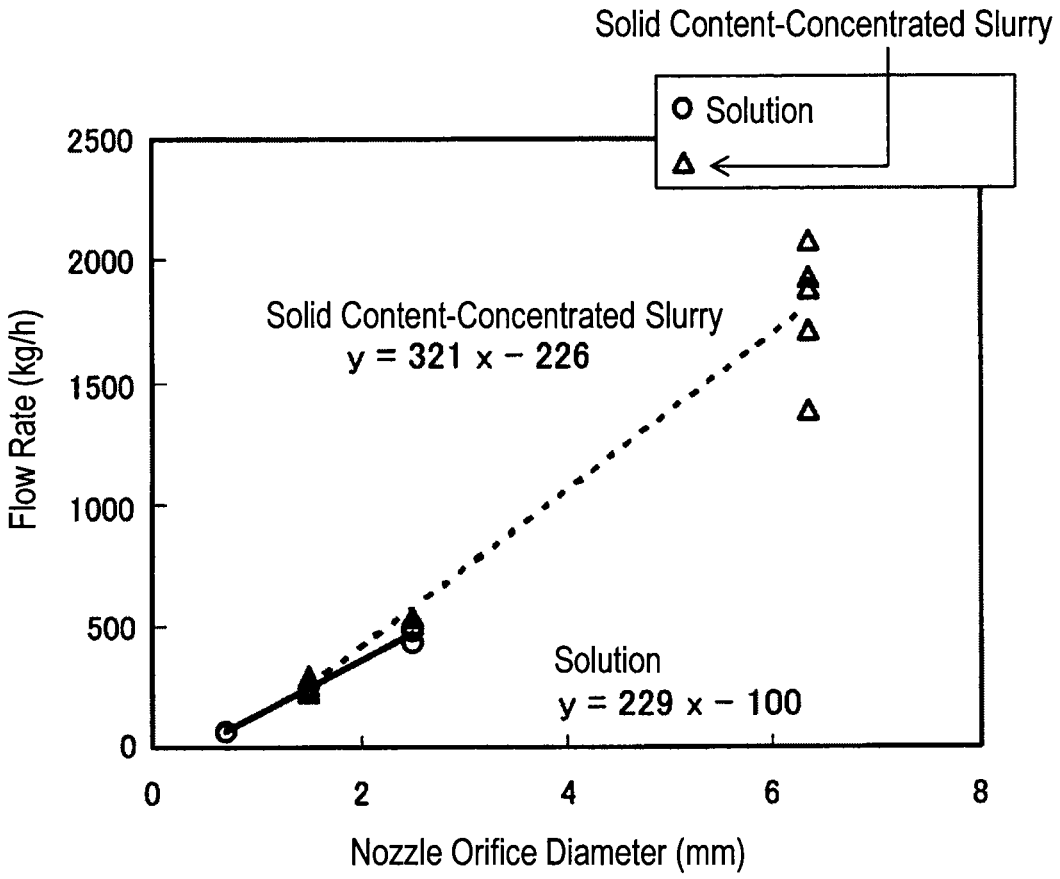
FIG. 2 is a view showing evaluation results of nozzle flow rate.

The relationship between a nozzle orifice diameter of the spray nozzle and flow rates of the solution and solid content-concentrated slurry that flow in the spray nozzle when clogging does not occur in the spray nozzle was evaluated, respectively. This evaluation was conducted by making the solution and solid content-concentrated slurry when Xstrata coal was used as a raw material coal in a high temperature and high pressure state of 360° C. and 2 MPa, respectively, such that the solvent is not allowed to be evaporated, and spraying the solution and solid content-concentrated slurry from the spray nozzle into the flash tank, respectively. The evaluation results are shown in FIG. 2.

It was found that the relationship between the nozzle orifice diameter and the flow rate of the solution when clogging does not occur in the spray nozzle, that is, volatilization of the solvent does not occur in the spray nozzle, is "flow rate (kg/h) of solution=229×nozzle orifice diameter (mm)−100". It was further found that the relationship between the nozzle orifice diameter and the flow rate of the solid content-concentrated slurry when clogging does not occur in the spray nozzle is "flow rate (kg/h) of solid content-concentrated slurry=321×nozzle orifice diameter (mm)−226". When those relationships are satisfied, the pressure on the upstream side of the nozzle orifice was 2 MPaG, and the pressure on the downstream side thereof was an atmospheric pressure. Thus, the solution and solid content-concentrated slurry become a plug flow state in the nozzle orifice, and the pressure of the solution and pressure of the solid content-concentrated slurry in the nozzle orifice are maintained at a level equal to or higher than the vapor pressure of the solvent, and thus, the evaporation of the solvent does not occur in the spray nozzle.

(Flash Test of Solid Content-Concentrated Slurry)

Flash test of spraying the solid content-concentrated slurry in the state that the solvent is not evaporated and separated into a flash tank of an ordinary pressure and then introducing a nitrogen gas into the flash tank was conducted. The test results are shown in FIG. 3.

Specifically, the solid content-concentrated slurry having a solvent content of from 31 to 36 wt % and using Xstrata coal as a raw material coal was fed to the spray nozzle under the conditions of 360° C. and 2 MPaG, and sprayed into a flash tank of an ordinary pressure. After completion of spraying, a nitrogen gas having a temperature of from 210 to 340° C. was introduced into the flash tank.

Figure 3:
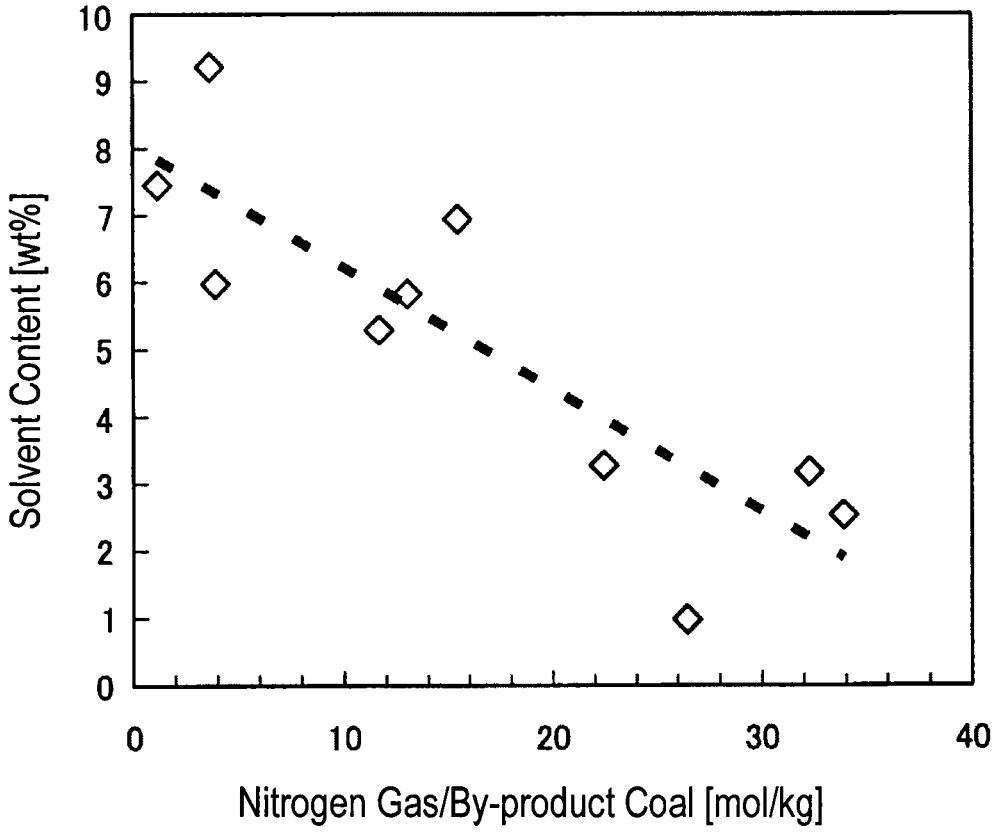
FIG. 3 is a view showing test results of a flash test of a solid content-concentrated slurry.

It is found from FIG. 3 that by utilizing the transition of from a non-equilibrium state to an equilibrium state by exposing the solid content-concentrated slurry in the state that the solvent is not evaporated and separated to the state of the pressure lower than the saturation pressure, the solvent is instantaneously evaporated and separated from the solid content-concentrated slurry, and the solvent content can be reduced to 10 wt % or less. It is further found that by removing solvent vapor from the circumference of the solid content-concentrated slurry with the nitrogen gas which has been introduced into the flash tank after completion of the spraying and substituting solvent vapor adsorbed in pores with the nitrogen gas, the solvent content of the by-product coal can be reduced. Particularly, it is found that the solvent content of the by-product coal can be reduced to about 2 wt % in a range that the value obtained by dividing the nitrogen gas [mol] by the by-product coal [kg] is from 25 to 35 [mol/kg].

(Flash Test of Solution)

Flash test of spraying the solution in the state that the solvent is not evaporated and separated into a flash tank of an ordinary pressure was conducted. The test results are show in FIG. 4.

Atmospheric single distillation test of subjecting a solution obtained in the case where Xstrata coal has been used as a raw material coal to single distillation was conducted, and the change with time of a solvent concentration of a solution calculated from the temperature of the solution and the total weight of the solution was confirmed. The results obtained are A to C in FIG. 4. A boiling point curve estimated from boiling point elevation is obtained from the results.

Flash test of using solutions using Xstrata coal as a raw material coal and having a solvent concentration of 62.5 wt % and 40 wt % as the respective samples, feeding those to the spray nozzle under the conditions of 360° C. and 2 MPaG, and spraying those into a flash tank of an ordinary pressure was conducted, and the relationship between an average temperature in the flash tank during spraying and a solvent content of a sample recovered from the flash tank after spraying was confirmed. The results are explanatory notes ○ and Δ in FIG. 4. By this flash test, ashless coals having a solvent content of 10.3 wt %, 7.8 wt %, 4.1 wt % and 0.6 wt % were obtained in an average temperature in the flash tank of from 280 to 290° C.

A solution of 360° C. and 2 MPaG having a solvent concentration of 62.5 wt % and a solution of 360° C. and 2 MPaG having a solvent concentration of 40 wt % were depressurized to an ordinary pressure, respectively, and the relationship between the temperature of the solution and the solvent content when isenthalpic change had been performed was calculated based on thermodynamics. The calculated values are curve D and curve E in FIG. 4.

Figure 4:
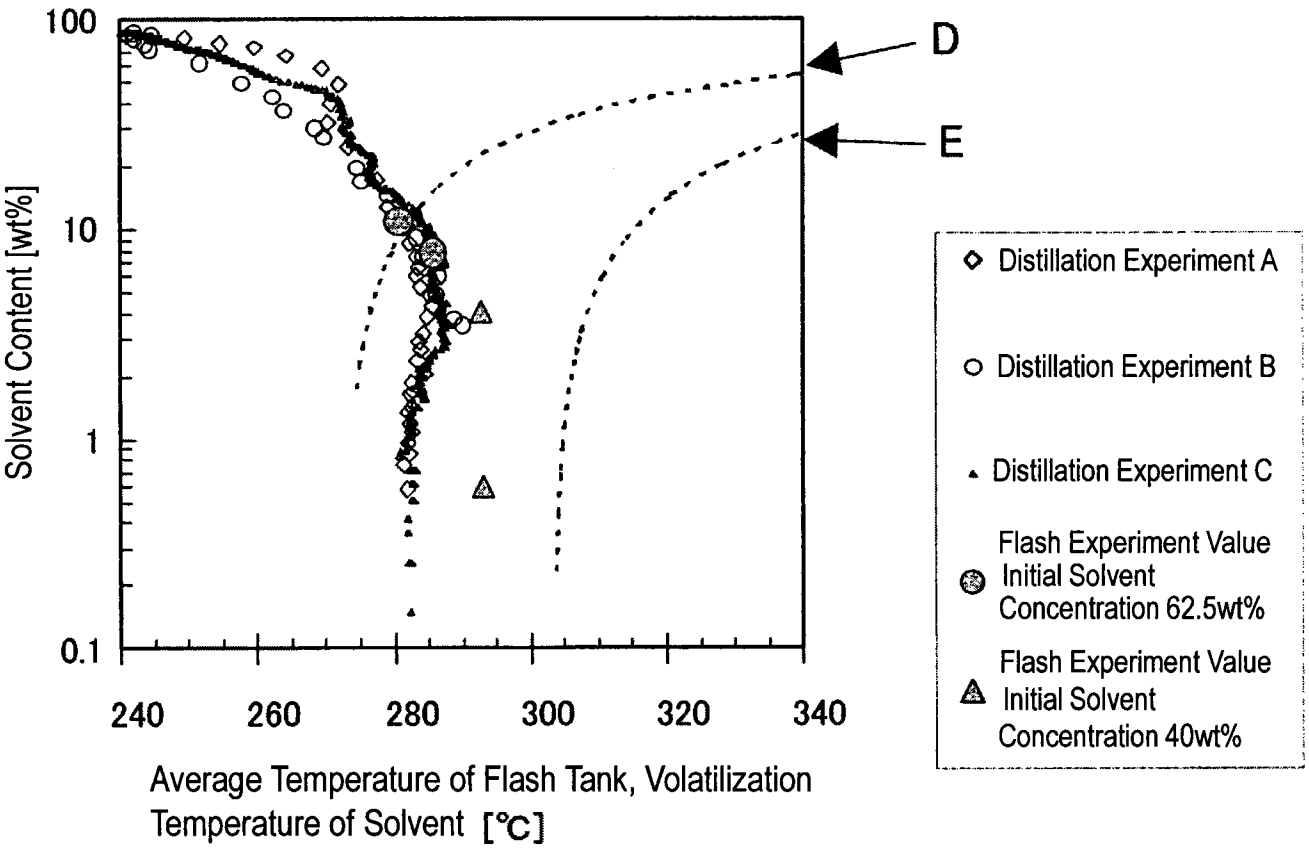
FIG. 4 is a view showing test results of a flash test of a solution.

It is found from FIG. 4 that the solvent can be instantaneously evaporated and separated from the solution by utilizing the transition in isenthalpic change of from a non-equilibrium state to an equilibrium state by exposing the solution in the state that the solvent is not evaporated and separated, to the state of the pressure lower than the saturation pressure. It is further found that the solvent content of the ashless coal which has been obtained by the flash test is a value in the vicinity of an intersection point between estimation curves D and E of the solvent content calculated based on thermodynamics and a boiling point curve obtained by an atmospheric single distillation test, or is a value between both curves in the case where the intersection point is not present.

(Effects)

As mentioned above, according to the method for producing an ashless coal according to the present embodiment, the pressure of the solid content-concentrated slurry in the nozzle orifice (ejection port) of the spray nozzle is maintained at a level equal to or higher than the vapor pressure of the solvent in the by-product coal acquirement step. Clogging of the spray nozzle sometimes occurs in the following case: when the pressure of the solvent of the solid content-concentrated slurry is lower than the saturation pressure before the nozzle orifice, the solvent is volatilized, and a liquid phase component in the solid content-concentrated slurry is decreased, and fluidity is decreased or lost. Therefore, the solvent is not allowed to be volatilized before the nozzle orifice by maintaining the pressure of the solid content-concentrated slurry in the nozzle orifice at a level equal to or higher than the vapor pressure of the solvent. This can prevent clogging of the spray nozzle.

In the by-product acquirement step, the solid content-concentrated slurry is sprayed into the flash tank in which the pressure is set to lower than the saturation pressure of the solid content-concentration slurry from the spray nozzle. The solid content-concentrated slurry becomes a non-equilibrium state by spraying the solid content-concentrated slurry which has been in the state that the solvent is not evaporated and separated into the flash tank to expose to the state of the pressure lower than the saturation pressure. The state changes to an equilibrium state at that pressure by evaporative separation of the solvent from the solid content-concentrated slurry. Relaxation time which is the time required for the transition (evaporation of the solvent) of from a non-equilibrium state to an equilibrium state is short as from about 0.01 to 0.1 second. Therefore, volatilization phenomenon occurs in a very short period of time as compared with the conventional heat transfer step. Therefore, the solvent can be instantaneously evaporated and separated from the solid content-concentrated slurry by utilizing the transition of from the non-equilibrium state to the equilibrium state. Because of this, a heat transfer step of heating the solid content-concentrated slurry and mechanisms necessary for the step can be omitted. Therefore, input energy required for volatilization of the solvent is reduced, and an apparatus for volatilizing the solvent can be simplified.

In the by-product coal acquirement step, an inert gas is brought into contact with the by-product coal which has been obtained by evaporative separation of the solvent from the solid content-concentrated slurry. The by-product coal is porous particles and has properties of adsorbing the solvent. Therefore, the by-product coal adsorbs the vapor in an amount up to about 5 wt % in a solvent vapor atmosphere. Therefore, the solvent vapor is removed from the circumference of the by-product coal by contacting the inert gas with the by-product coal, and the solvent vapor adsorbed in pores is substituted with the inert gas. This can reduce the solvent content of the by-product coal.

In the ashless coal acquirement step, the pressure of the solution in the nozzle orifice (ejection port) of the spray nozzle is maintained at a level equal to or higher than the vapor pressure of the solvent. Clogging of the spray nozzle sometimes occurs in the following case: the pressure of the solution is lower than the saturation pressure before the nozzle orifice, and the solvent is volatilized, and then, the temperature of the solution is decreased by adiabatically expanding a gas component, and a solid matter is precipitated. Therefore, the solvent is not allowed to be volatilized before the nozzle orifice by maintaining the pressure of the solution in the nozzle orifice at a level equal to or higher than the vapor pressure of the solvent. This can prevent clogging of the spray nozzle.

In the ashless coal acquirement step, the solution is sprayed from the spray nozzle into the flash tank in which the pressure is set to lower than the saturation pressure of the solution. The solution becomes a non-equilibrium state by spraying the solution which has been in the state that the solvent is not evaporated and separated into the flash tank to expose to the state of the pressure lower than the saturation pressure. The state changes to an equilibrium state at that pressure by evaporative separation of the solvent from the solution and adiabatic expansion of the solvent vapor. Relaxation time which is the time required for the transition (volatilization of the solvent) of from a non-equilibrium state to an equilibrium state is short as from about 0.01 to 0.1 second. Therefore, volatilization phenomenon occurs in a very short period of time as compared with the conventional heat transfer step. Therefore, the solvent can be instantaneously evaporated and separated from the solution by utilizing the transition of from the non-equilibrium state to the equilibrium state. Because of this, a heat transfer step of heating the solution and mechanisms necessary for the step can be omitted. Therefore, input energy required for volatilization of the solvent is reduced, and an apparatus for volatilizing the solvent can be simplified.

In the ashless coal acquirement step, the pressure of the solution in the nozzle orifice is maintained at a level equal to or higher than the saturation pressure of the solution. The saturation pressure of the solution is lower than the vapor pressure of the solvent by vapor pressure depression phenomenon. Therefore, when the pressure of the solution in the nozzle orifice is maintained at a level equal to or higher than the saturation pressure of the solution, the solvent is not volatilized. This can prevent volatilization of the solvent before the nozzle orifice by the pressure lower than the vapor pressure of the solvent.

The values of the temperature and pressure of the solution fed to the ashless coal acquirement step and the values of the temperature and pressure in the flash tank are set, respectively, in consideration of isenthalpic change of the solution in the flash tank and boiling point elevation phenomenon of the solvent. The relationship between the temperature of the solution by isenthalpic change of the solution and the solvent content can be estimated based on thermodynamics. The boiling point by boiling point elevation phenomenon of the solvent generated by dissolving a coal component soluble in a solvent in the solvent can be estimated from molality of the coal component. The solvent content of the ashless coal obtained by spraying into the flash tank is a value in the vicinity of an intersection point between an estimation curve of the solvent content calculated based on thermodynamics and a boiling point curve assumed from the boiling point elevation, or is a value between both curves in the case where the intersection point is not present. Therefore, the solvent content of the ashless coal obtained in the ashless coal acquirement step can be adjusted by setting the values of the temperature and pressure of the solution fed to the ashless coal acquirement step and the values of the temperature and pressure in the flash tank, respectively, in consideration of isenthalpic change of the solution in the flash tank and boiling point elevation phenomenon of the solvent.

In the ashless coal acquirement step, the solvent is further evaporated and separated from the solution from which the solvent has been evaporated and separated by spraying into the flash tank. Specifically, another flash distillation tank, thin film distillation apparatus or the like is provided on the downstream side of the solvent separator 9, and the solvent is further evaporated and separated from the solution discharged from the solvent separator 9. Thus, the solvent content of the ashless coal obtained in the ashless coal acquirement step can be adjusted to a predetermined value or less by repeatedly conducting evaporative separation of the solvent from the solution.

(Modification Examples of Present Embodiment)

Although an exemplary embodiment in the present invention has been described in the foregoing, it merely exemplifies the concrete example and should not be construed as particularly limiting the present invention. The concrete configuration and on the like can be modified as appropriate. Further, the actions and effects described in the embodiment in the present invention are merely recited as the most appropriate actions and effects produced by the present invention, and actions and effects which can be achieved by the present invention should not be construed as being limited to those described in the exemplary embodiment in the present invention.

This application is based on Japanese Patent Application No. 2013-085780 filed on Apr. 16, 2013, the contents of which are incorporated herein by reference.

INDUSTRIAL APPLICABILITY

The present invention is effective in a step of producing an ashless coal from a coal, can reduce input energy required for volatilization of a solvent and additionally can simplify an apparatus for volatilizing a solvent.

DESCRIPTION OF REFERENCE NUMERALS AND SIGNS

1: Coal hopper
2: Solvent tank
3: Slurry preparation tank
3*a*: Stirrer
4: Transport pup
5: Preheater
6: Extraction tank
6*a*: Stirrer
7: Gravitational settling tank
8: Filter unit
9, 10: Solvent separator
100: Ashless coal production equipment

The invention claimed is:

1. A method for producing an ashless coal, comprising:

mixing a coal with a solvent to prepare a slurry;

heating the slurry to extract a coal component soluble in the solvent;

separating the slurry, after the heating, into a solution in which the coal component soluble in the solvent is dissolved and a solid content-concentrated slurry in which a coal component insoluble in the solvent is concentrated under pressure equal to or higher than a vapor pressure of the solvent;

evaporating and separating the solvent from the solution which has been separated to yield an ashless coal;

evaporating and separating the solvent from the solid content-concentrated slurry which has been separated by spraying the solid content-concentrated slurry into a flash tank in which a pressure is set to lower than a saturation pressure of the solid content-concentrated slurry from a spray nozzle while maintaining a pressure of the solid content-concentrated slurry in a nozzle orifice of the spray nozzle at a level equal to or higher than the vapor pressure of the solvent to yield a by-product coal;

introducing into the flash tank to substitute solvent vapor with inert gas in the flash tank, and contacting the by-product coal with the inert gas.

2. The method of claim 1, wherein the evaporating and separating is performed in the presence of an inert gas.

3. The method of claim 1, wherein the coal is mixed with the solvent in an amount of 10 to 50 wt % on a dried coal basis.

4. The method of claim 1, wherein the coal is mixed with the solvent in an amount of 20 to 35 wt % on a dried coal basis.

5. The method of claim 1, wherein the slurry is heated to a temperate of from 300 to 420° C.

6. The method of claim 1, wherein the slurry is heated to a temperate of from 360 to 400° C.

* * * * *